US005508159A

United States Patent [19]

Okuyama et al.

[11] Patent Number: 5,508,159

[45] Date of Patent: Apr. 16, 1996

[54] SILVER HALIDE PHOTOGRAPHIC LIGHT-SENSITIVE MATERIAL

[75] Inventors: Masato Okuyama; Yukio Ohya, both of Odawara, Japan

[73] Assignee: Konica Corporation, Japan

[21] Appl. No.: 373,497

[22] Filed: Jan. 17, 1995

Related U.S. Application Data

[63] Continuation of Ser. No. 185,481, Jan. 21, 1994, abandoned.

[30] Foreign Application Priority Data

Feb. 8, 1993 [JP] Japan ..... 2-020272

[51] Int. Cl.$^6$ ..... G03C 1/035; G03C 1/08

[52] U.S. Cl. ..... 430/567; 430/581; 430/614; 430/584; 430/588; 430/600

[58] Field of Search ..... 430/567, 581, 430/614, 584, 588, 600

[56] References Cited

U.S. PATENT DOCUMENTS 5,147,770 9/1992 Waki et al. ..... 430/567
5,246,828 9/1993 Okuyama et al. ..... 430/614

FOREIGN PATENT DOCUMENTS 509810 10/1992 European Pat. Off. .

*Primary Examiner*—Janet C. Baxter
*Attorney, Agent, or Firm*—Jordan B. Bierman; Bierman and Muserlian

[57] ABSTRACT

A silver halide photographic light-sensitive material is disclosed, which comprises a support and provided thereon, a silver halide emulsion layer containing a crown ether having a 18-membered ring condensed with at least one aromatic ring and silver halide grains having a (100) face and satisfying the following inequality:

$$15 \leq K$$

wherein K is defined to be (intensity of a diffraction line attributed to a (200) face)/(intensity of a diffraction line attributed to a (222) face).

7 Claims, No Drawings

SILVER HALIDE PHOTOGRAPHIC LIGHT-SENSITIVE MATERIAL

This application is a continuation of application Ser. No. 08/185,481, filed Jan. 21, 1994.

FIELD OF THE INVENTION

The present invention relates to a silver halide photographic light-sensitive material, more particularly to a high-speed silver halide photographic light-sensitive material wherein sensitivity fluctuation caused by long term storage of a raw product has been improved.

BACKGROUND OF THE INVENTION

Heretofore, demand for a silver halide photographic light-sensitive material has been severe year by year. In addition to the demand for the enhancement of sensitivity and of high image quality (especially excellent graininess and sharpness), processing compatibility with low replenishment to reduce environmental pollution and rapid processing property for finishing in a short time. Most of these demands can be solved by attaining enhancement of sensitivity of silver halide grains. It is no exaggeration to say that the enhancement of the sensitivity of silver halide grains is the most important theme in this industry.

With regard to the enhancement of the sensitivity of silver halide grains, many studies have been conducted for a long time. More concretely, there are methods of chemical sensitization and spectral sensitization. Methods described below are known.

As a method for enhancing sensitivity by means of chemical sensitization, chemical sensitization methods such as an independent use or combination use of sulfur sensitization, noble metal sesitization (for example, gold sensitization, paradium sensitization, platinum sensitization, irridium sensitization and selenium sensitization are cited) reduction sensitization are known.

In addition, for example, methods to use as a spectral sensitization dye used in spectral sensitization, cyanine dyes such as a zeromethine dye, a monomethine dye, a dimethine dye, a trimethine dye and a merocyanine dye independently or in combination (for example, super sensitization) are known.

The above-mentioned technologies are described also in U.S. Pat. Nos. 2,688,545, 2,912,329, 3,397,060, 3,615,635 and 3,628,964, British Patent Nos. 1,195,302, 1,242,588 and 1,293,862, German Patent (OLS) Nos. 2,030,326 and 2,121, 780 and Japanese Patent Publication Nos. 4936/1968 and 14030/1969.

Of the above-mentioned technologies, in a practical light-sensitive material, especially in a color light-sensitive material, a technology of spectral sensitization in which silver halides having a specific sensitivity to a blue light are sensitized by a green light or a red light is essential.

One method for obtaining a high sensitivity by means of spectral sensitization is to select an appropriate combination condition of the above-mentioned chemical sensitization method and spectral sensitization method. However, it is insufficient, by this method only, to cope with the above-mentioned requests on light-sensitive materials.

Another method is to select an appropriate sensitizing dye. Conditions to be satisfied as a sensitizing dye used for photographic materials satisfy not only that high spectrally-sensitized sensitivity can be obtained but also that there is no augmentation in fogging when the sensitizing dye is added to a silver halide emulsion, its spectral absorption properties are excellent, properties when subjected to exposure (for example, excellent latent image stability and little dependency to humidity and temperature in exposure) are excellent, the changing in terms of fogging rising, sensitivity and gradation in the course of preservation of raw samples (a light-sensitive material before being subjected to exposure and development) are small, deterioration at white background due to the remaining of the sensitizing dye in the light-sensitive material after photographic processing is not caused, and the sensitizing dye is excellent in terms of production stability and the like. However, it is extremely difficult to choose a sensitizing dye which satisfies all of the above-mentioned.

In addition, as a method for enhancing sensitivity, it is known that a super sensitization method is useful. Super sensitization is described in Photographic Science and Engineering, Volume 13, pp. 13 –17 (1969) and Volume 18, pp. 418–430 (1974) and The Theory of the Photographic Process 4th edition, page 259, published by MacMillan Inc., 1977. It is known that, by selecting suitable sensitizing dyes and super sensitizers, high sensitivity can be obtained.

Heretofore, many compounds such as stilbene, azaindene, mercaptoheterocycles, thiourea and condensed compounds between phenol and hexamethylenetetraamine have been known as a super sensitizer. For example, they are disclosed in U.S. Pat. Nos. 2,875,058, 3,340,064, 3,457,078, 3,458, 318, 3,615,632, 3,695,888 and 4,011,083 and Japanese Patent Publication Open to Public Inspection (hereinafter referred to as "Japanese Patent O.P.I. Publication") No. 203447/1986.

However, from results of the experiments conducted by the present inventors, it was discovered, though the reason is not clear, that the fluctuation and deterioration of photographic sensitivity of raw samples due to natural aging is noticeable when the sensitivity is enhanced using the above-mentioned prior arts in order to satisfy the above-mentioned requests on light-sensitive materials. Storage stability of the raw sample of a photographic light-sensitive material is extremely important because uniformity of photographic performance is demanded. Accordingly, deterioration of the photographic performance after the preservation of raw samples has been a big obstacle for the practical enhancement of sensitivity. In addition, when a super sensitizer as disclosed in Japanese Patent O.P.I. Publication No. 25833/1992 is applied to photographic emulsions, development inhibition occurs in photographic processing so that request for rapid processing cannot be satisfied.

As stated above, technologies to realize enhancement of sensitivity without deteriorating various photographic properties have been demanded.

SUMMARY OF THE INVENTION

An object of the present invention is to provide a silver halide photographic light-sensitive material wherein its storage stability is excellent and high sensitivity can be obtained continually.

CONSTITUTION OF THE INVENTION

The object of the present invention can be attained by a silver halide photographic light-sensitive material comprising a silver halide emulsion layer containing silver halide grains having a (100) face and one or more kinds of crown ethers having an 18-membered ring condensed with at least one aromatic ring.

DETAILED DESCRIPTION OF THE INVENTION

Silver halide grains used in the present invention have a crystal habit mainly composed of a (100) face. The silver halide grains can be obtained by a well-known method, for example, the method comprising adding, to a gelatin solution containing sodium chloride, a solution containing potassium bromide and sodium chloride in molar ratio of 1:99 and a silver nitrate solution by a double-jet method. These grains are preferably cubic grains and/or tetradecahedral grains and more preferably silver halide grains which satisfy $15 \leqq K$ when K is defined to be (the intensity of a diffraction line attributed to a (200) face)/(the intensity of a diffraction line attributed to a (222) face).

The intensity is measured by an X-ray diffraction analysis method described in Japanese Patent O.P.I. Publication No. 29243/1984.

The red sensitive sensitizing dye usd in the present invention includes cyanine dyes such as a cyanine dye, a merocyanine dye and a horopolar dye, complex cyanine dyes and complex merocyanine dyes. Of these, cyanine dyes represented by the following Formulas (I) and/or (II) are desirably cited.

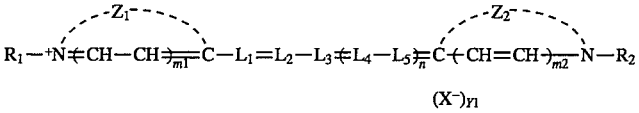

Formula (I)

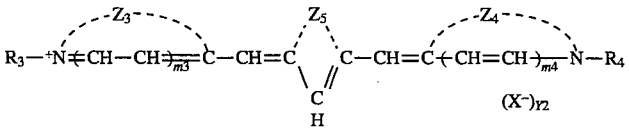

Formula (II)

wherein $R_1$, $R_2$, $R_3$ and $R_4$ independently represent an alkyl group, an alkenyl group or an aryl group; $L_1$, $L_2$, $L_3$, $L_4$ and $L_5$ independently represent a methine group; $Z_1$, $Z_2$, $Z_3$ and $Z_4$ independently represent an atom or atomic group necessary for forming a 5- or 6-membered heterocyclic ring; $Z_5$ represents a hydrocarbon atomic group necessary for forming a 6-member ring; $m_1$, $m_2$, $m_3$ and $m_4$ independently represent 0 or 1; n represents 0 or 1; $X^-$ represents an acid anion; $Y_1$ and $Y_2$ independently represent 0 or 1, provided that $Y_1$ and $Y_2$ independently represent when the compound forms an inner salt.

In sensitizing dyes used in the present invention, alkyl groups represented by $R_1$, $R_2$, $R_3$ and $R_4$ in formulas (2) or (3) may be branched. In addition, sensitizing dyes having 10 or fewer carbons are more preferable. They may have a substituent. As a substituent, a sulfo group, an aryl group, a carboxy group, an amine (primary, secondary and tertiary) group, an alkoxy group, an aryloxy group, a hydroxy group, an alkoxycarbonyl group, an acyloxy group, an acyl group, an aminocarbonyl group or a cyan group or a halogen atom can be cited. Practical examples of alkyl groups are a methyl group, an ethyl group, a propyl group, a butyl group, a pentyl group, a hexyl group, a heptyl group, a sulfoethyl group, a sulfopropyl group, a sulfobutyl group, a benzyl group, a phenethyl group, a carboxyethyl group, a carboxymethyl group, a dimethylaminopropyl group, a methoxyethyl group, a phenoxypropyl group, a methylsulfonylethyl group, a p-t-butylphenoxyethyl group, a cyclohexyl group, an octyl group, a decyl group, a carbamoylethyl group, a sulfophenethyl group, a sulfobenzyl group, a 2-hydroxy-3-sulfopropyl group, an ethoxycarbonylethyl group, a 2,3-disulfopropoxypropyl group, a sulfopropoxyethoxyethyl group, a trifluoroethyl group, a carboxybenzyl group, a cyanopropyl group, a p-carboxyphenethyl group, an ethoxycarbanylmethyl group, a pivaloylpropyl group, a propyonylethyl group, an anisyl group, an acetoxyethyl group, a benzoyloxypropyl group, a chloroethyl group, a morphorinoethyl group, an acetylaminoethyl group, an N-ethylaminocarbonylpropyl group and a cyanoethyl group are cited.

As alkenyl groups, those having 10 or less carbons are preferable. For example, an allyl group, a 2-butenyl group and a 2-propenyl group are cited.

In addition, as aryl groups, a phenyl group, a carboxyphenyl group and a sulfonyl group are cited.

A methine group represented by $L_1$, $L_2$, $L_3$, $L_4$ and $L_6$ in formula (I) or (II) may have a substituent. When it has a substituent, it is represented by a formula (—$CR_5$—). As a group represented by $R_5$, straight-chained or branched alkyl groups (for example, a methyl group, an ethyl group, a propyl group, a butyl group, a carboxyl group and a benzyl group), alkoxy groups (for example, a methoxy group and an ethoxy group) and aryl groups (for example, a phenyl group and a tolyl group) are cited.

As anions represented by $X^-$ in formulas (I) and (II), a chloride ion, bromide ion, iodide ion, perchloroxide ion, fluorinated borate ion, p-toluenesulfonic acid ion, ethylsulfonic acid ion, methylsulfonic acid ion and nitrate ion are cited.

In addition, of the sensitizing dyes represented by the above-mentioned formula (I) or (II), especially useful sensitizing dyes can be represented by the following formulas (III) and (IV).

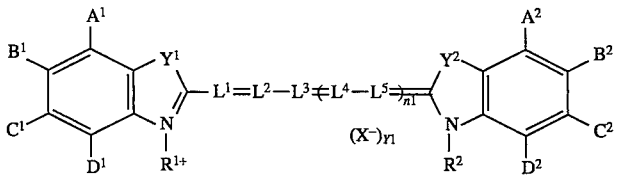

Formula (III)

-continued

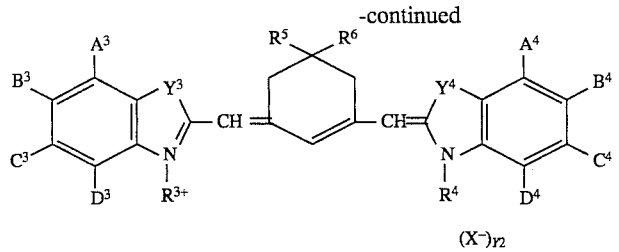

Formula (IV)

wherein $Y^1$, $Y^2$, $Y^3$ and $Y^4$ independently represent an oxygen atom, a sulfur atom or a selenium atom; $A^1$, $A^2$, $A^3$, $A^4$, $B^1$, $B^2$, $B^3$, $B^4$, $C^1$, $C^2$, $C^3$, $C^4$, $D^1$, $D^2$, $D^3$ and $D^4$ independently represent a hydrogen atom, a halogen atom, an alkyl group, an alkoxy group, a phenyl group, a cyano group, a nitro group or an alkoxycarbonyl group, provided that at least one combination of $A^1$ and $B^1$, $B^1$ and $C^1$, $C^1$ and $D^1$, $A^2$ and $B^2$, $B^2$ and $C^2$, $C^2$ and $D^2$, $A^3$ and $B^3$, $B^3$ and $C^3$, $C^3$ and $D^3$, $A^4$ and $B^4$, $B^4$ and $C^4$ and $C^4$ and $D^4$ may be bound together to form a benzene ring; $R^5$ and $R^6$ independently represent a lower alkyl group, for example, a methyl group, an ethyl group, a propyl group, a butyl group or a trifluoromethyl group; $R^1$, $R^2$, $R^3$, $R^4$, $L^1$, $L^2$, $L^3$, $L^4$, $L^5$, $X^-$, $n^1$, $Y^1$ and $Y^2$ are the same as $R_1$, $R_2$, $R_3$, $R_4$, $L_1$, $L_2$, $L_3$, $L_4$, $L_5$, $X^-$, $n^1$, $Y_1$ and $Y_2$ in the above-mentioned formula (I) or (II).

As alkyl groups represented by $A^1$, $A^2$, $A^3$, $A^4$, $B^1$, $B^2$, $B^3$, $B^4$, $C^1$, $C^2$, $C^3$, $C^4$, $D^1$, $D^2$, $D^3$ and $D^4$ in formula (III) or (IV), straight-chained or branched-chained lower alkyl groups having 1 to 5 carbons (for example, a methyl group, an ethyl group, a propyl group, a butyl group and a trifluoromethyl group) are cited. As alkoxy groups represented by them, straight-chained or branched-chained alkoxy groups having 1 to 5 carbons (for example, a methoxy group and an ethoxy group) are cited. As halogen atoms represented by them, fluorine, chlorine, bromine or iodine are cited. As phenyl groups, a phenyl group not having a substituent, a hydroxyphenyl group and a carboxyphenyl group are cited. As alkoxycarbonyl groups, a methoxycarbonyl group and an ethoxycarbonyl group are cited. In addition, $n^1$ represents 0 or 1, provided that 1 is preferable.

Next, practical examples of red sensitive sensitizing dyes of the present invention are illustrated. However, the present invention is not limited thereto.

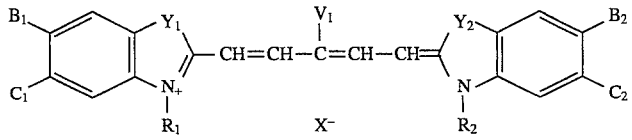

TABLE 1

| Illustrated compound No. | $Y_1$ | $Y_2$ | $B_1$ | $C_1$ | $B_2$ | $C_2$ | $R_1$ | $R_2$ | $V_1$ | $X^-$ |
|---|---|---|---|---|---|---|---|---|---|---|
| I-1 | Se | Se | H | H | H | H | $C_2H_5$ | $C_2H_5$ | H | I |
| I-2 | S | S | H | H | H | H | $C_2H_5$ | $C_2H_5$ | H | I |
| I-3 | Se | Se | H | H | H | H | $(CH_2)_2OCH_3$ | $(CH_2)_2OCH_3$ | H | Br |
| I-4 | Se | S | H | H | H | H | $(CH_2)_3SO_3H$ | $C_2H_5$ | H | — |
| I-5 | S | S | H | $OCH_3$ | H | H | $C_2H_5$ | $C_2H_4OH$ | $C_2H_5$ | Br |
| I-6 | S | S | $C_2H_5$ | H | $C_2H_5$ | H | $C_5H_{11}$ | $C_5H_{11}$ | $C_2H_5$ | Br |
| I-7 | S | S | $C_2H_5$ | H | $C_2H_5$ | H | $C_5H_{11}$ | $C_5H_{11}$ | $C_4H_9$ | Br |
| I-8 | S | S | $OCH_3$ | $OCH_3$ | $OCH_3$ | $OCH_3$ | $C_2H_5$ | $C_2H_5$ | $CH_3$ | I |
| 1-9 | 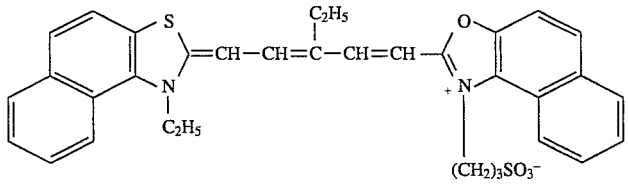 | | | | | | | | | |

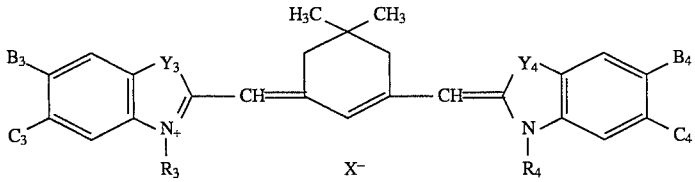

TABLE 2

| Illustrated compound No. | $Y_3$ | $Y_4$ | $B_3$ | $C_3$ | $B_4$ | $C_4$ | $R_3$ | $R_4$ | $X^-$ |
|---|---|---|---|---|---|---|---|---|---|
| II-1 | S | S | H | H | H | H | $C_2H_5$ | $C_2H_5$ | Br |
| II-2 | S | S | $CH_3$ | H | H | H | $C_2H_5$ | $C_2H_5$ | Br |
| II-3 | S | S | $CH_3$ | H | $CH_3$ | H | $C_2H_5$ | $C_2H_5$ | I |
| II-4 | S | S | H | H | H | H | $C_2H_5$ | $C_3H_7$ | I |
| II-5 | S | S | H | H | H | H | $C_2H_5$ | $C_4H_9$ | I |
| II-6 | S | S | H | H | H | H | $C_2H_5$ | $C_5H_{11}$ | Br |
| II-7 | S | S | H | H | H | H | $C_2H_5$ | $C_7H_{15}$ | Br |
| II-8 | S | S | H | H | H | H | $C_2H_5$ | $C_{10}H_{21}$ | Br |
| II-9 | S | S | H | H | H | H | $C_3H_7$ | $C_3H_7$ | Br |
| II-10 | S | S | H | H | H | H | $C_4H_9$ | $C_4H_9$ | PTS$^{-*}$ |
| II-11 | S | S | H | H | H | H | $C_5H_{11}$ | $C_5H_{11}$ | Br |
| II-12 | S | S | H | H | H | H | $C_7H_{15}$ | $C_7H_{15}$ | Br |
| II-13 | S | S | $CH_3$ | H | H | H | $C_2H_5$ | $C_5H_{11}$ | Br |
| II-14 | S | S | $CH_3$ | H | $CH_3$ | H | $C_2H_5$ | $C_5H_{11}$ | Br |
| II-15 | S | S | $OCH_3$ | H | H | H | $C_2H_5$ | $C_2H_5$ | Br |
| II-16 | S | S | $OCH_3$ | H | H | H | $C_2H_5$ | $C_5H_{11}$ | Br |
| II-17 | S | S | $CH_3$ | $CH_3$ | $CH_3$ | $CH_3$ | $C_2H_5$ | $C_2H_5$ | Br |
| II-18 | S | S | $C_3H_{7(i)}$ | H | $C_3H_{7(i)}$ | H | $C_2H_5$ | $C_2H_5$ | Br |
| II-19 | S | S | H | H | H | H | $C_2H_5$ | $(CH_2)_3SO_3^-$ | — |
| II-20 | S | S | $CH_3$ | H | $CH_3$ | H | $C_2H_5$ | $(CH_2)_4SO_3^-$ | — |
| II-21 | S | S | $CH_3$ | H | $CH_3$ | H | $(CH_2)_3SO_3HN(C_2H_5)_3$ | $(CH_2)_3SO_3^-$ | |
| II-22 | S | O | H | H | H | H | $C_2H_5$ | $C_2H_5$ | Br |
| II-23 | S | O | $CH_3$ | H | $CH_3$ | H | $C_2H_5$ | $C_5H_{11}$ | Br |
| II-24 | Se | Se | H | H | H | H | $C_2H_5$ | $C_2H_5$ | Br |
| II-25 | Se | Se | $CH_3$ | H | $CH_3$ | H | $C_2H_5$ | $C_2H_5$ | Br |
| II-26 | 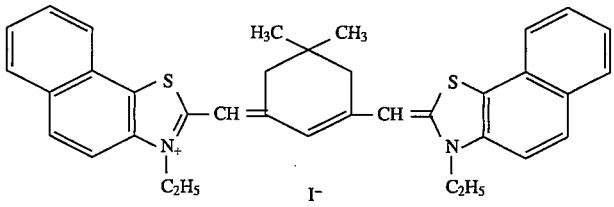 | | | | | | | | |
| II-27 | 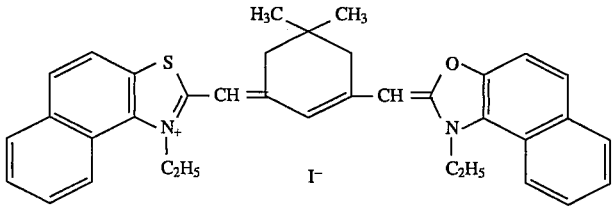 | | | | | | | | |

(*PTS: Paratoluene sulfonic acid)

The above-mentioned red sensitive sensitizing dyes can easily be synthesized by a method described in The Chemistry of Heterocyclic Compounds written by F. M. Harmer, Volume 18 and The Cyanine Dyes and Related Compounds, New York, 1964 published by A. Weissberger ed. Interscience Co., Ltd.).

There is no limitation to the amount of adding the above-mentioned red sensitive sensitizing dyes. However, it is preferred to add $2\times10^{-8}$ to $1\times10^{-2}$ mol per mol of silver halide.

Next, crown ethers used in the present invention will be explained. They are crown ethers with a 18-membered ring condensed with one or more substituted or unsubstituted aromatic rings. As a substituent, an alkyl group, an aryl group, an anilino group, an acylamino group, a sulfonamide group, an alkylthio group, an arylthio group, an alkenyl group and a cycloalkyl group are typically cited. In addition, halogen atoms, a cycloalkenyl group, an alkinyl group, a heterocycle, a sulfonyl group, a sulfinyl group, a phosphonyl group, an acyl group, a carbamoyl group, a sulfamoyl group, a cyano group and an alkoxy group are cited. Besides, hetero atoms constituting a crown ring may be substituted with a nitrogen atom, a sulfur atom and a selenium atom, in place of an oxygen atom. Typical compounds are crown ethers. Since Pedersen synthesized them in 1967 and reported their specific characteristics as described below, many compounds have been synthesized. They are described in detail in C. J. Pedersen, Journal of American chemical Society, vol. 86 (2495), 7017– 7036 (1967), G. W. Gokel, S. H, Korzeniowski, "Macrocyclic polyether synthesis", Springer-Verlag. (1982), "Chemistry of crown ether" edited by Oda, Shono and Tabuse, Kagaku Dojin (1978), "Host-Guest" edited by Tabuse, Kyoritsu Shuppan (1979) and "Organic synthetic chemistry" edited by Sasaki and Koga, vol. 45 (6), pp. 571–582 (1987).

Hereunder, practical examples of macrocyclic compounds containing hetero-atoms used in the present invention are illustrated. However, the present invention is not limited thereto.

S-1
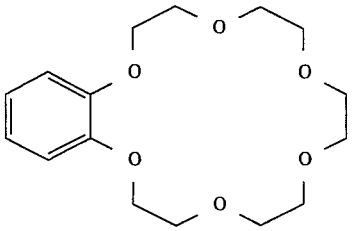
S-2
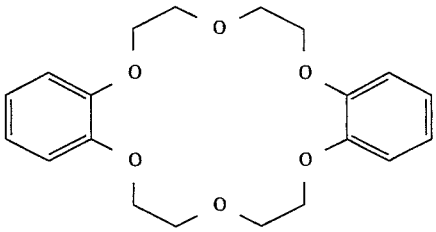
S-3
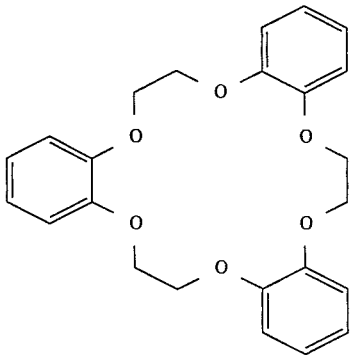
S-4
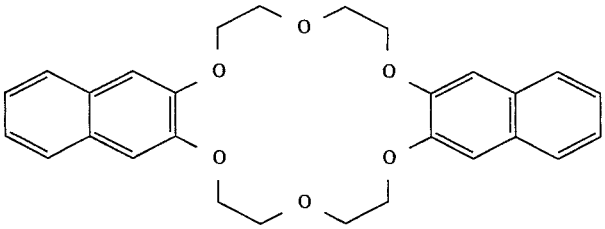
S-5
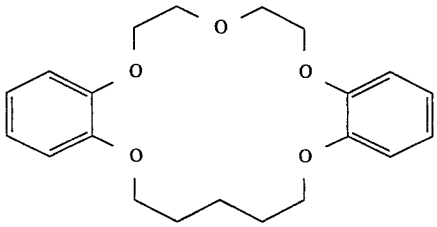
S-6
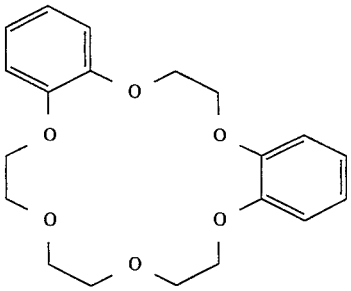
S-7
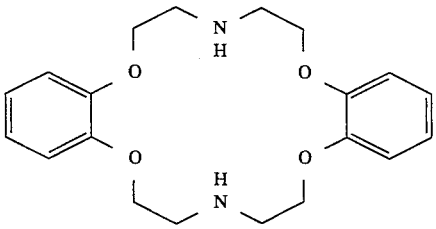
S-8
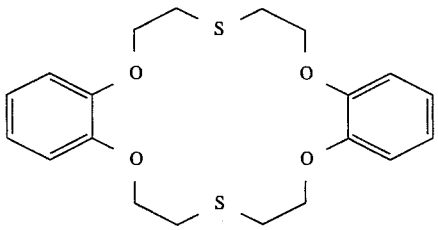

-continued
S-9
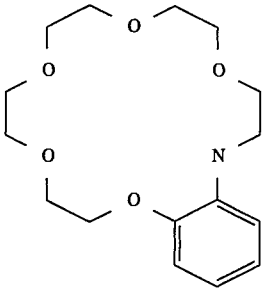
S-10
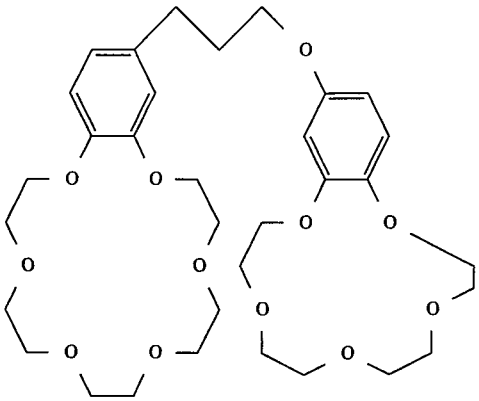
S-11
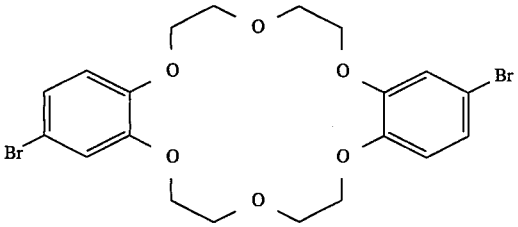
S-12
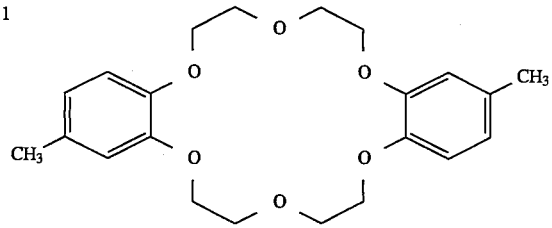
S-13
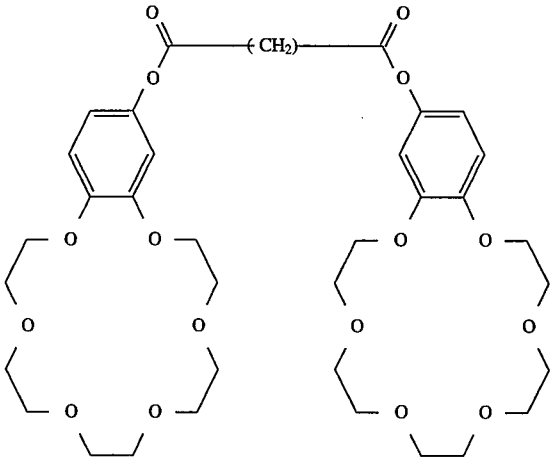
S-14
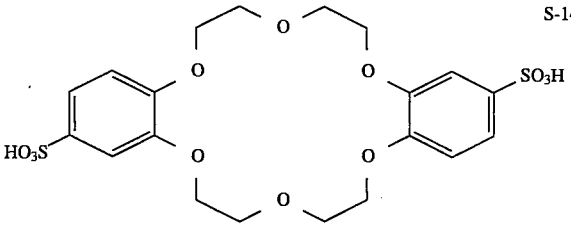
S-15
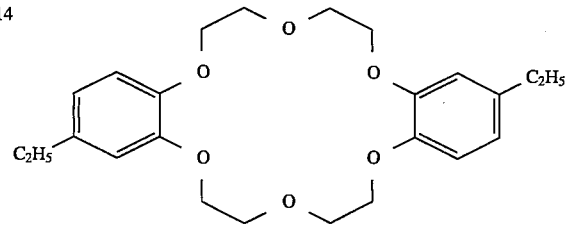

-continued
S-16
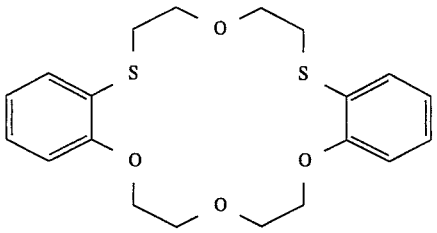
S-17
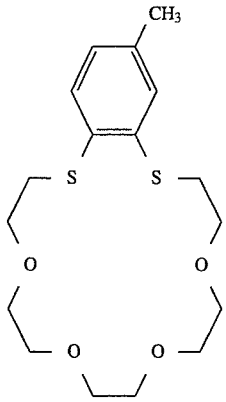
S-18
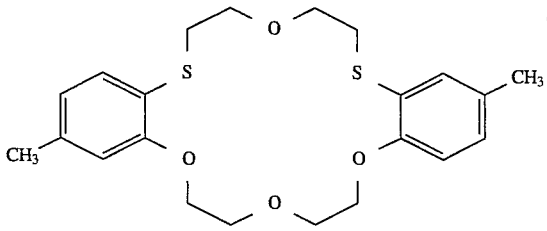
S-19
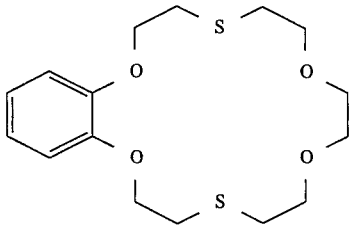
S-20
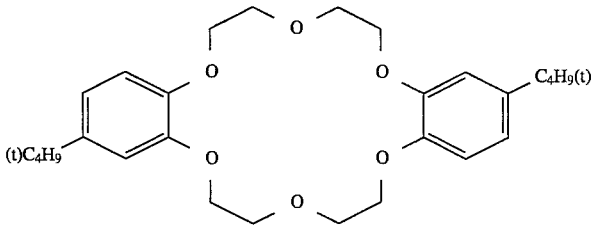
S-21
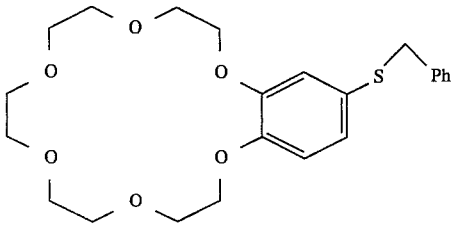
S-22
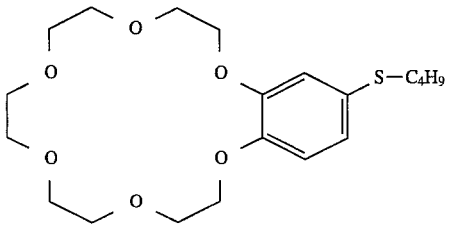
S-23
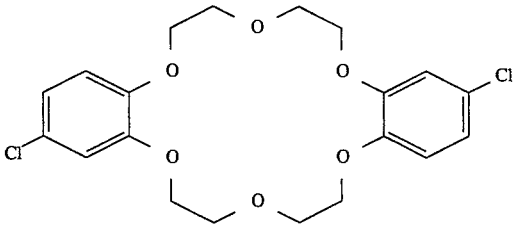
S-24
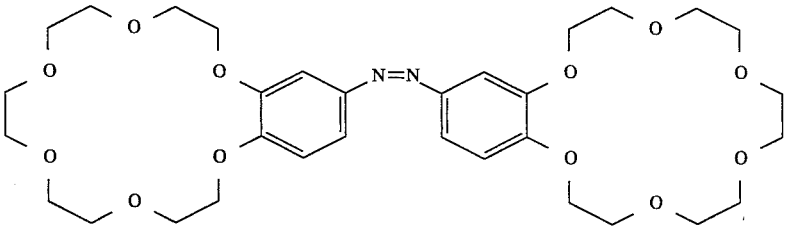

-continued

S-25

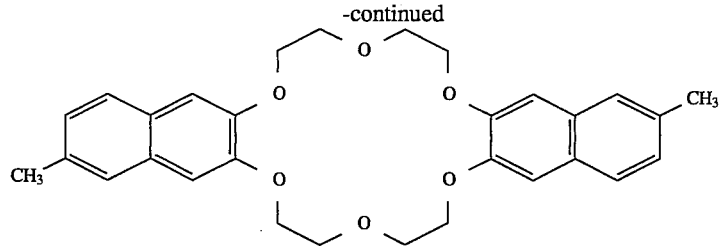

Crown ethers containing silver halide grains of the present invention may be added to hydrophilic colloid containing silver halide grains after being dissolved into water or hydrophilic organic solvents such as methanol, ethanol, fluorinated alcohol. With regard to addition timing, any time is allowed provided that it is before the coating of emulsions. However, it is preferred to be added before completion of chemical sensitization.

With regard to the order of adding the red sensitive sensitizing dye and the crown ether, there is no limitation thereto. Both may be added concurrently, or a mixed solution of the red sensitive sensitizing dye and the crown ether may be prepared in advance of adding. The amount of adding crown ethers of the present invention is different depending upon the kind of them. However, it is ordinarily in the range of $1\times 10^{-6}$ to $1\times10^{-1}$ mol and preferably $5\times10^{-6}$ to $1\times10^{-2}$ mol per mol of silver halide.

Silver halides applicable to the present invention include arbitrary silver halide including silver chloride, silver bromide, silver iodide, silver bromochloride, silver bromoiodide and silver bromoiodochloride. A silver halide grain preferably used in the present invention is silver bromochloride, and one more preferably used is silver bromochloride wherein the silver bromide content is 0.01 to 2 mol %. The composition of the silver halide grain may be uniform throughout its entire portions from the core to the superficial portion of the grain, or composition at the core portion may be different from that of the superficial portion. When composition differs between the core of the grain and the superficial portion of the grain, it may differ either continuously or stepwise. In addition, as described in Japanese Patent O.P.I. Publication No. 183647/1989, the grain may have a localized phase wherein the composition of halide is different locally.

There is no limitation to the grain size of silver halide grains. However, considering other photographic properties such as rapid processing property and sensitivity, the grain size is preferred to be 0.2 to 1.6 μm and more preferred to be 0.25 to 1.2 μm. The above-mentioned grain size is represented by an average grain size of the grain diameter when the grain is spherical or close to sphere or of the edge length when the grain is cubic based on the projected area. The distribution of the grain size of silver halide grains may be poly-dispersed or may be mono-dispersed. The preferable is a mono-dispersed silver halide grain wherein the fluctuation coefficient in the grain distribution of the silver halide grain is 0.22 or less and the more preferable is a mono-dispersed silver halide grain wherein the fluctuation coefficient in the grain distribution of the silver halide grain is 0.15 or less.

In the present invention, a silver halide grain used for an emulsion may be prepared by either of an acidity method, a neutral method or an ammonia method. Aforesaid grain may be grown at a time or may be grown after a seed grain is prepared.

It is preferred that a silver halide material used in the present invention has not only a red sensitive silver halide emulsion layer but also a blue sensitive silver halide emulsion layer and a green sensitive silver halide emulsion layer in addition. These layers are optically sensitized using a sensitizing dye.

As a sensitizing dye, a cyanine dye, a merocyanine dye, a complex cyanine dye, a complex merocyanine dye, a holopolar cyanine dye, a hemicyanine dye, a styryl dye and a hemioxanol dye can be used. These sensitizing dyes may be used independently or 2 or more dyes may be used in combination. Together with the sensitizing dye, a super sensitizer enhancing sensitization effect of a sensitizing dye which is a dye not having a spectral sensitization effect by itself or a compound substantially not absorbing visible light may be incorporated into the emulsion.

In addition, the above-mentioned sensitizing dyes can be used for adjusting gradation and photographic processing in addition to the specific objects as a spectral sensitization effects.

To the silver halide emulsion of the present invention, an anti-foggant or a stabilizer can be added at any time either before silver halide grains are formed, during silver halide grains are formed, between completion of forming of silver halide grains and the starting of chemical ripening, during chemical ripening, when chemical ripening is completed or between completion of chemical ripening and the time of coating.

As a binder for the silver halide photographic light-sensitive material used in the present invention, it is profitable to use gelatin. However, at need, gelatin derivatives, grafted polymer between gelatin and other polymers, other proteins, sugar derivatives, cellulose derivatives and hydrophilic colloid such as synthetic hydrophilic polymers including homopolymers and copolymers.

Dye forming couplers such as a yellow coupler, a magenta coupler and a cyan coupler are used for the silver halide photographic light-sensitive material of the present invention.

In the present invention, as a yellow coupler, it is preferred to use acylacetoanilido type couplers. Of them, benzoylacetoanilido type compounds and pyvaloylacetoanilido type compounds are profitable. Especially, illustrated compounds Y-1 through Y-146 described in Japanese Patent O.P.I. Publication No. 85631/1988, illustrated compounds Y-1 through Y-98 described in Japanese Patent O.P.I. Publication 97951/1988 and illustrated compounds Y-1 through Y-24 described on pp. 67 to 78 of Japanese Patent O.P.I. Publication No. 156748/1989 are preferably used.

As a magenta coupler used in the present invention, oil-protect type indazolone or cyanoacetyl couplers, and preferably, 5-pyrazolone couplers and pyrazoloazole couplers including pyrazolotriazole couplers are cited. As a magenta coupler preferably used in the present invention, magenta couplers represented by the following Formulas (M-I) and (M-XI) are cited.

Formula (M-I)

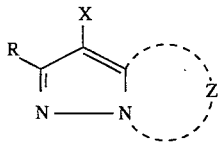

wherein Z represents a nonmetallic atom group necessary for forming a nitrogen-containing heterocycle; a ring formed by aforesaid z may have a substituent; X represents a hydrogen or a group capable of being split off through a reaction with an oxidized product of a color developing agent; R represents a hydrogen atom or a substituent; though there is no limitation to a substituent represented by R, typically, an alkyl group, an aryl group, an anilino group, an acylamino group, a sulfonamide group, an alkylthio group, an arylthio group, an alkenyl group and a cycloalkyl group are cited; in addition, halogen atoms, a cycloalkenyl group, an alkinyl group, a heterocycle, a sulfonyl group, a sulfinyl group, a phosphonyl group, an acyl group, a carbamoyl group, a sulfamoyl group, a cyano group and an alkoxy group are cited.

As practical examples of compounds represented by Formula (M-I), M-1 through M-61 described from the lower left column on page 9 to the lower right column on page 5 of Japanese Patent O.P.I. Publication No. 167360/1988 and Nos. 1 to 4, 6, 8 to 17, 19 to 24, 26 to 43, 45 to 59, 61 to 104, 106 to 121, 123 to 162, 164 to 223 described from the upper right column on page 18 to the upper right column on page 32 of Japanese Patent O.P.I. Publication No. 166339/1987 are cited.

Formula (M-XI)

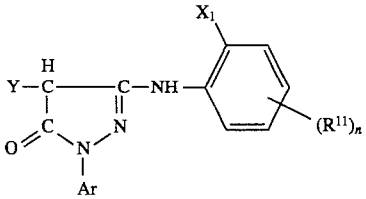

wherein Ar represents an aryl group; $X_1$ represents a halogen atom, an alkoxy group or an alkyl group; $R^{11}$ represents a group capable of being substituted with a benzene ring; n represents 1 or 2; when n is 2, $R^{11}$ may be the same or different each other; Y represents a group capable of being split off through a coupling reaction with an oxidized product of an aromatic primary amine type color developing agent.

In Formula (M-XI), Y represents a group capable of being split off through a coupling reaction with an oxidized product of an aromatic primary amine type color developing agent including, for example, a halogen atom, an alkoxy group, an aryloxy group, an acyloxy group, an arylthio group, an alkylthio group and a 5-membered or 6-membered heterocycle.

As a coupler represented by formula (M-XI), illustrated compound Nos. 218 through 244 described in Japanese Patent O.P.I. Publication No. 52138/1988 are cited. In addition, compounds described in U.S. Pat. Nos. 2,600,788, 3,061,432, 3,062,653, 3,127,269, 3,311,476, 3,152,896, 3,419,391, 3,519,429, 3,555,318, 3,684,514, 3,888,680, 3,907,571, 3,928,044, 3,930,861, 3,930,866 and 3,933,500, Japanese Patent O.P.I. Publication Nos. 29639/1974, 111631/1974, 129538/1974, 13041/1975, 58922/1977, 62454/1980, 118034/1980, 38043/1981, 35858/1982, 2953/1985, 23855/1985 and 60644/1985, British Patent No. 1,247,493, Belgium Patent Nos. 789,116 and 792,525, German Patent No. 2,156,111 and Japanese Patent Publication Nos. 60479/1971 and 36577/1982.

As a cyan coupler, phenol type cyan couplers and naphthol type cyan couplers are used. As a cyan coupler preferably used in the present invention, cyan couplers represented by the following Formulas (C-I) and (C-II).

Formula (C-I)

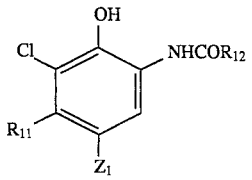

wherein $R_{11}$ represents an alkyl group having 2 to 6 carbons; $R_{12}$ represents a ballast group; $Z_1$ represents a hydrogen atom or an atom or group capable of being split off through a reaction with an oxidized product of a color developing agent; an alkyl group represented by $R_{11}$ may be straight-chained or branched, which includes those having a substituent; a ballast group represented by $R_{12}$ is an organic group having a size and a form capable of giving coupler molecules enough bulk for substantially preventing diffusion of couplers from the layer to be applied to other layers.

As aforesaid ballast group, the preferable are represented by the following Formula.

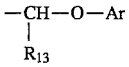

wherein $R_{13}$ represents an alkyl group having 1 to 12 carbon atoms; Ar represents an aryl group such as a phenyl group; this aryl group includes those having a substituent. As practical examples of cyan couplers represented by Formula (C-I), illustrated compounds PC-1 through PC-19 described on pp. 116 through 119 of Japanese Patent O.P.I. Publication No. 156748/1989, illustrated compounds C-1 through C-28 and cyan couplers described in Japanese Patent Publication No. 11572/1974 and Japanese Patent O.P.I. Publication Nos. 3142/1986, 9652/1986, 9653/1986, 50136/1986, 99141/1986 and 105545/1986 are cited.

Formula (C-II)

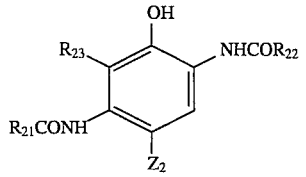

wherein $R_{21}$ represents an alkyl group or an aryl group; $R_{22}$ represents an alkyl group, a cycloalkyl group, an aryl group or a heterocycle; $R_{23}$ represents a hydrogen atom, a halogen atom, an alkyl group or an alkoxy group; $R_{23}$ and $R_{21}$ may form a ring in combination; $Z_2$ represents a hydrogen atom or a group capable of being split off through a reaction with an oxidized product of an aromatic primary amine type color developing agent.

In cyan couplers represented by the above-mentioned formula (C-II), an alkyl group represented by $R_{21}$ preferably has 1 to 32 carbon atoms, which may be straight-chained or branched on may include a substituent. As an aryl group represented by $R_{21}$, a phenyl group is preferable, the aryl group includes those having a substituent. As an alkyl group represented by $R_{22}$, those having 1 to 32 carbon atoms are preferable. These alkyl groups may be straight-chained or branched or include those having a substituent. As a cycloalkyl group represented by $R_{22}$, those having 3 to 12 carbon atoms are preferable. These cycloalkyl groups include those having a substituent. As an aryl group represented by $R_{22}$, a phenyl group is preferable and the aryl group includes those having a substituent. As a heterocycle represented by $R_{22}$, those having 5 to 7-membered ring are preferable. These include those having a substituent, and they may be condensed.

$R_{23}$ represents a hydrogen atom, a halogen atom, an alkyl group or an alkoxy group. Aforesaid alkyl group and aforesaid alkoxy group may include those having a substituent. $R_{23}$ is preferably a hydrogen atom.

In addition, as a ring formed through a combination of $R_{21}$ and $R_{23}$, those having 5 to 6 membered ring are preferable. Examples of such a ring include the following compound;

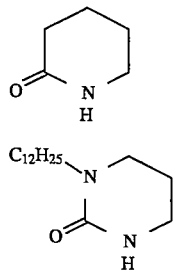

In Formula (C-II), as a group capable of being split off through a reaction with an oxidized product of a color developing agent represented by $Z_2$, a halogen atom, an alkoxy group, an aryloxy group, an acyloxy group, a sufonyloxy group, an acylamine group, a sulfonylamino group, an alkoxycarbonyloxy group, an aryloxycarbonyloxy group and an imide group are cited (also including those having a substituent respectively). The preferable are a halogen atom, an aryloxy group and an alkoxy group.

Of the above-mentioned cyan couplers, the preferable are those represented by the following Formula (C-II-A).

Formula (C-II-A)

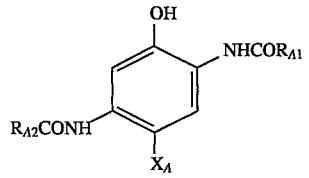

wherein $R_{A1}$ represents a phenyl group substituted by at least one halogen atom. These phenyl groups further include those having a substituent other than a halogen atom.

$R_{A2}$ represents the same as $R_{21}$ of the above-mentioned Formula (C-II). $X_A$ represents a halogen atom, an aryloxy group or an alkoxy group, and also includes those having a substituent.

As typical examples of cyan couplers represented by Formula (C-II), illustrated compounds C-1 through C-25 described in Japanese Patent O.P.I. Publication No. 96656/1988, illustrated compounds PC-II-1 through PC-II-31 described on pp. 124 through 127 of Japanese Patent O.P.I. Publication No. 156748/1989 and 2,5-diacylamino type cyan couplers described from the lower right column on page 7 to the lower left column on page 9 of Japanese Patent O.P.I. Publication No. 178962/1987, those described from the lower left column on page 7 to the lower right column on page 10 of Japanese Patent O.P.I. Publication No. 225155/1985, those described from the upper left column on page 6 to the lower right column on page 8 of Japanese Patent O.P.I. Publication No. 222853/1985 and those described from the lower left column on page 6 to the upper left column on page 9 of Japanese Patent O.P.I. Publication No. 185335/1984.

The above-mentioned hydrophobic compounds such as dye forming couplers are dissolved in a high boiling solvent having a boiling point of not lower than 150° C. or a water-insoluble polymer compound independently or in combination with a low boiling organic solvent or a water-soluble organic solvent. Then, using a surfactant, the solution is emulsified and dispersed by means of a stirrer, a homogenizer, a colloid mill, a flow jet mixer and a supersonic apparatus in a hydrophilic binder such as an aqueous gelatin solution. The resulting mixture may be added to a hydrophilic colloidal layer targeted.

In the present invention, as a high boiling organic solvent, those having a dielectric constant of less than 6.0 are preferably used. There is no limitation to the lower limit of the dielectric constant. However, it is preferable to be 1.9 or more including, for example, esters such as ester phthalate and ester phosphate, organic amides, ketones and hydrocarbon compounds. As practical examples of high boiling organic solvent, illustrated organic solvents 1 through 22 described in Japanese Patent O.P.I. Publication No. 166331/1987 are cited.

To the silver halide photographic light-sensitive material of the present invention, a water-soluble dye, an anti-color fogging agent, an image stabilizer, a hardener, a Plasticizer, a polymer latex, a UV absorber, a formalin scavenger, a mordant, a development accelerator, a development retarder, a fluorescent brightening agent, a matting agent, a lubricant, an anti-static agent and a surfactant can arbitrarily be added.

Photographic constituting layers of the silver halide photographic light-sensitive material of the present invention can be coated on a baryta paper, a paper on which α-olefin polymer or the like is laminated, a paper support wherein the paper support and α-olefin layer can be peeled off easily, a flexible reflection support such as a synthetic paper and a reflection support wherein a white pigment is contained or coated on a semi-synthetic or synthetic film such as cellulose acetate, cellulose nitrate, polystyrene, vinyl polychloride, polyethyrene tetrphthalate, polycarbonate and polyamide. In addition, a thin reflective support having a thickness of 120 to 160 μm can also be used.

As white pigments, inorganic and/or organic white pigments can be used. The preferred are inorganic white pigments. For example, sulfate of alkaline earth metals such as barium sulfate, carbonate salts of alkaline earth metals such as calcium carbonate, silicas such as fine silicate and synthetic silicate, calcium silicate, alumina, alumina hydrate, titanium oxide, zinc oxide, talc and clay are cited. The preferred white pigments are barium sulfate and titanium oxide.

After the surface of the support is provided with corona discharge, UV ray irradiation and firing treatment if necessary, a light-sensitive materials may be coated directly or through subbing layers (one or two or more subbing layer in order to improve adhesivity, anti-static property stability in sizing, anti-abrasion property, stiffness, anti-halation property, abrasion property and/or other properties of the surface of the support.)

When a light-sensitive materials using silver halide emulsions is coated, a thickener may be used. As coating methods, an extrusion coating method and a curtain coating method is especially advantageous because they can coat 2 or more layers concurrently. The light-sensitive material of the present invention is subjected to photographic processing so that images can be formed.

Color developing agents which are used in color developers in the present invention include aminophenol type and p-phenylenediamine type derivatives which are commonly used in various color photographic processes.

To color developers applicable to the processing of light-sensitive materials of the invention, conventional developer component compounds in addition to the above-mentioned primary aromatic amine type color developing agents can be added.

pH value of the color developers are ordinarily 9 or more and preferably about 10 to 13.

The temperature of color developer is ordinarily 15° C. or more, and normally 20° C. to 50° C. The temperature of rapid processing is preferably 30° C. or more.

Time for developing is ordinarily from 10 seconds to 4 minutes. For rapid processing, it is preferable to be in the range from 10 seconds to 1 minute. When furthermore rapid processing is required, it is preferable to be in the range from 10 seconds to 30 seconds. However, the effects of the present invention can be offered more effectively in such a rapid processing.

In addition, when the light-sensitive material of the present invention is subjected to running processing wherein a replenisher for the color developing agent is consecutively replenished, the replenising amount of the color developer is preferably 20–150 $m_1$, more preferably 20–120 ml and still more preferably 20–100 ml per $m^2$ of the material. However, the effects of the present invention can be offered more effectively in such a running processing with low replenishing. To the light-sensitive materials of the present invention, bleach-fixing processing is provided after subjecting to color developing.

After subjecting to bleach-fixing processing, the light-sensitive material is subjected to a washing process or a stabilizing process or a combination process thereof.

EXAMPLES

Hereunder, practical examples of the present invention are shown. However, the present invention is not limited thereto.

Example 1

To a 2% aqueous gelatin solution kept at 40° C. were added simultaneously an aqueous solution wherein sodium bromide and sodium chloride were contained in the molar ratio of 30:70 and an aqueous silver nitrate solution while stirring vigorously under pAg of 6.0 and pH of 3.5. After that, the solution was subjected to desalting by the use of a 10% aqueous solution of Demol N produced by Kao Atlas Co., Ltd. and a 30% aqueous solution of magnesium sulfate. Then, the resulting solution was mixed with an aqueous gelatin solution to prepare a mono-dispersed cubic emulsion having fluctuation coefficient (standard deviation of the grain size/the average grain size) of 0.07 and a silver chloride content of 70 mol %.

When the resulting emulsion was subjected to X-ray analysis and K value was calculated, K value was 2550.

Next, pAg regulated or the composition of silver halide changed, Em-2 to Em-6 were prepared in the same manner as in Em-1, wherein K value was changed. Em-7 having a K value of 0.4 was prepared in view of Examples of Japanese Patent O.P.I. Publication No. 141649/1993.

The above-mentioned Em-1 through Em-7 were subjected to the most suitable sensitization at 65° by the use of sodium thiosulfate, chloro aurate, a red sensitive sensitizing dye and a super sensitizer or crown ethers of the present invention. The red sensitive sensitizing dye Exemplified dye, No. II-1 was used in an amount of $4\times10^{-5}$ mol/mol Ag and the crown ethers or super sensitizer was used in an amount of $1\times 10^{-3}$ mol/mol Ag. Thus, a red sensitive silver halide emulsion was prepared.

Table 3 shows results thereof.

The above obtained emulsion was mixed with the below-mentioned emulsified dispersant so that coating solutions were prepared. The coating solutions were coated on a paper support laminated with polyethylene on both surfaces to prepare Samples 101 through 132.

As a protective layer, gelatin was coated. In a protective layer, 2,4-dichloro-6-hydroxy-s-sodium triazine (H-1) was added as a hardener.

Emulsified dispersant

Cyan couplers CC-1 and CC-2 were dissolved in a mixed solution of dioctyl phthalate (DOP) and ethyl acetate together with an anti-stain agent HQ-1, a dye image stabilizer ST-1, and after that, the solution was emulsified and dispersed in a 8% aqueous gelatin solution containing Alkanol B (produced by Du Pont).

| | | Added amount ($g/m^2$) |
|---|---|---|
| Protective layer | Gelatin | 1.0 |
| Red sensitive layer | Red sensitive emulsion | 0.3 in terms of silver |
| | Cyan coupler (CC-1) | 0.3 |
| | Cyan coupler (CC-2) | 0.1 |
| | Dye image stabilizer (ST-1) | 0.2 |
| | Anti-stain agent (HQ-1) | 0.01 |
| | DOP | 0.2 |
| | Gelatin | 1.0 |
| Support | Polyethylene-laminated paper | |

TABLE 3

| Emulsion | Composition ratio of halogen (Cl:Br) | K value {(200)/(222)} |
|---|---|---|
| EM-1 | 70:30 | 2550 |
| Em-2 | 70:30 | 850 |
| Em-3 | 70:30 | 20 |
| Em-4 | 70:30 | 5 |
| Em-5 | 70:30 | 0.4 |
| Em-6 | 99:1 | 2550 |
| Em-7 | 99:1 | 0.4 |

Comparative compound (A)

Condensed product of phenol and hexamethylene tetraamine

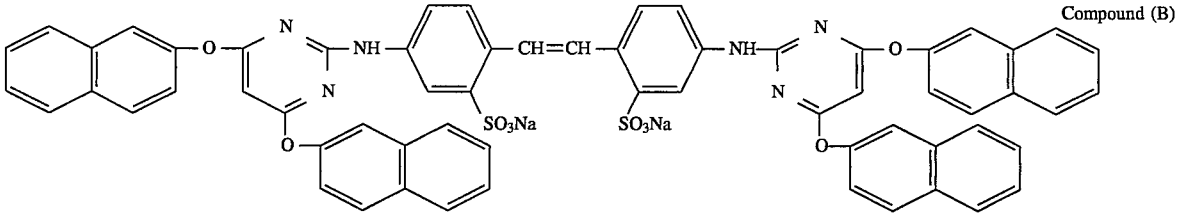

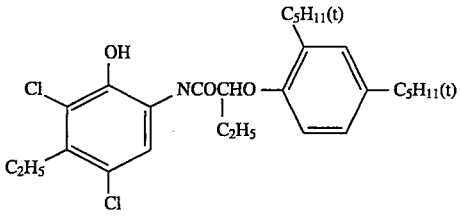

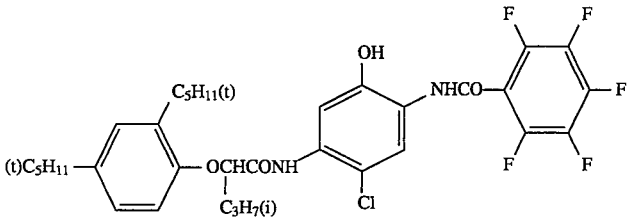

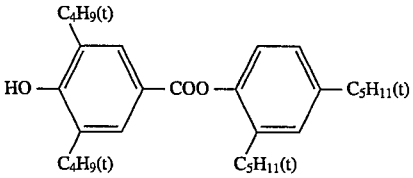

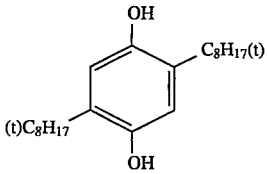

Table 4 shows the coated composition in Samples 101 to 132. (T-1 to T-32 are a combination of emulsions constituting Samples 101 to 132 and crown ethers added to the emulsions.)

TABLE 4

| Sample No. | Emulsion | Crown ether of the present invention | Constituting No. of Emulsion and Crown ether |
|---|---|---|---|
| 101 (Comparative) | Em-1 | None | T-1 |
| 102 (Comparative) | Em-2 | None | T-2 |
| 103 (Comparative) | Em-3 | None | T-3 |
| 104 (Comparative) | Em-4 | None | T-4 |
| 105 (Comparative) | Em-5 | None | T-5 |
| 106 (Comparative) | Em-6 | None | T-6 |
| 107 (Comparative) | Em-7 | None | T-7 |
| 108 (Comparative) | Em-1 | Comparative compound A | T-8 |
| 109 (Comparative) | Em-4 | Comparative compound A | T-9 |
| 110 (Comparative) | Em-5 | Comparative compound A | T-10 |
| 111 (Comparative) | Em-6 | Comparative compound A | T-11 |
| 112 (Comparative) | Em-7 | Comparative compound A | T-12 |
| 113 (Comparative) | Em-1 | Comparative compound B | T-13 |
| 114 (Comparative) | Em-3 | Comparative compound B | T-14 |
| 115 (Comparative) | Em-5 | Comparative compound B | T-15 |
| 116 (Comparative) | Em-7 | Comparative compound B | T-16 |
| 117 (Invention) | Em-1 | S-1 | T-17 |

TABLE 4-continued

| Sample No. | Emulsion | Crown ether of the present invention | Constituting No. of Emulsion and Crown ether |
|---|---|---|---|
| 118 (Invention) | Em-2 | S-1 | T-18 |
| 119 (Invention) | Em-3 | S-1 | T-19 |
| 120 (Comparative) | Em-5 | S-1 | T-20 |
| 121 (Invention) | Em-6 | S-1 | T-21 |
| 122 (Comparative) | Em-7 | S-1 | T-22 |
| 123 (Invention) | Em-2 | S-2 | T-23 |
| 124 (Invention) | Em-3 | S-2 | T-24 |
| 125 (Comparative) | Em-4 | S-2 | T-25 |
| 126 (Comparative) | Em-5 | S-2 | T-26 |
| 127 (Invention) | Em-6 | S-2 | T-27 |
| 128 (Invention) | Em-1 | S-3 | T-28 |
| 129 (Invention) | Em-3 | S-3 | T-29 |
| 130 (Comparative) | Em-5 | S-3 | T-30 |
| 131 (Invention) | Em-6 | S-3 | T-31 |
| 132 (Comparative) | Em-7 | S-3 | T-32 |

The resulting samples were subjected to sensitometry by the use of the following method so that relative sensitivity and storage stability of a raw sample were evaluated.

(Evaluation of relative sensitivity)

For the evaluation of sensitivity, each sample was subjected to optical wedge exposure to light through a red filter for 0.5 second, and was subjected to the following development. The density of the resulting samples was measured by the use of an optical densitometer (Model PDA-65 produced by Konica Corporation). Then, the sensitivity of each sample was compared so that relative sensitivity was calculated.

(Evaluation on storage stability)

Each sample was stored for 3 months under the conditions of 25° C. and 60% RH. Then, they were subjected to exposure and processing in the same manner as above and the change of density ΔD were obtained according to the following Equation.

$$\Delta D = D(S) - 1.0$$

D(S): Density of the sample subjected to aging storage at an exposure amount which gives a density of 1.0 in a sample which is not subjected to aging storage.

The table 5 shows the results thereof.

| Processing step | Temperature | Time |
|---|---|---|
| Color developing | 35.0 ± 0.3° C. | 45 seconds |
| Bleach-fixing | 35.0 ± 0.5° C. | 45 seconds |
| Stabilizing | 30–34° C. | 90 seconds |
| Drying | 60–80° C. | 60 seconds |

(Color developing solution)

| | |
|---|---|
| Pure water | 800 ml |
| Triethanolamine | 10 g |
| N,N-diethylhydroxylamine | 5 g |
| Potassium bromide | 0.02 g |
| Potassium chloride | 2 g |
| Potassium sulfite | 0.3 g |
| 1-hydroxyethylidene-1,1-diphosphonic acid | 1.0 g |
| Ethylenediamine tetraacetic acid | 1.0 g |
| Disodium catechol-3.5-diphosphate | 1.0 g |
| N-ethyl-N-β-methanesulfonamidoethyl-3-methyl-4-aminoaniline sulfate | 4.5 g |
| Fluorescent brightening agent (4,4'-diaminostylbenesulfonate derivative) | 1.0 g |
| Potassium carbonate | 27 g |
| Water was added to make 1 l in total and pH was regulated to 10.10. | |

-continued (Bleach-fixer)

| | |
|---|---|
| Ferric ammonium ethylenediamine tetraacetate dehydrate | 60 g |
| Ethylenediamine tetraacetic acid | 3 g |
| Ammonium thiosulfate (70% aqueous solution) | 100 g |
| Ammonium sulfite (40% aqueous solution) | 27.5 ml |
| Water was added to make 1 l in total, and pH was regulated to potassium carbonate or glacial acetic acid to 5.7. | |

(Stabilizer)

| | |
|---|---|
| 5-chloro-2-methyl-4-isothiazoline-3-on | 1.0 g |
| Ethylene glycol | 1.0 g |
| 1-hydroxyethylidene 1,1-diphosphonic aicd | 2.0 g |
| Ethylenediamine tetraacetic acid | 1.0 g |
| Ammonium hydroxide (20% aqueous solution) | 3.0 g |
| Fluorescent brightening agent (4,4'-diaminostylbenesulfonate derivative) | 1.5 g |
| Water was added to make 1 l in total, and pH was regulated to 7.0 with sulfuric acid or potassium hydroxide. | |

Table 5 shows the results of the evaluation.

TABLE 5

| Sample No. | Relative sensitivity | Raw sample storage stability (ΔD) |
|---|---|---|
| 101 (Comparative) | 100 | 0.16 |
| 102 (Comparative) | 98 | 0.16 |
| 103 (Comparative) | 97 | 0.15 |
| 104 (Comparative) | 97 | 0.14 |
| 105 (Comparative) | 97 | 0.14 |
| 106 (Comparative) | 101 | 0.15 |
| 107 (Comparative) | 103 | 0.17 |
| 108 (Comparative) | 218 | 0.28 |
| 109 (Comparative) | 209 | 0.29 |
| 110 (Comparative) | 212 | 0.30 |
| 111 (Comparative) | 225 | 0.32 |
| 112 (Comparative) | 208 | 0.17 |
| 113 (Comparative) | 190 | 0.16 |
| 114 (Comparative) | 197 | 0.26 |
| 115 (Comparative) | 176 | 0.28 |
| 116 (Comparative) | 178 | 0.05 |
| 117 (Invention) | 262 | 0.04 |
| 118 (Invention) | 260 | 0.03 |
| 119 (Invention) | 257 | 0.04 |
| 120 (Comparative) | 211 | 0.06 |
| 121 (Invention) | 261 | 0.06 |
| 122 (Comparative) | 209 | 0.03 |
| 123 (Invention) | 272 | 0.04 |
| 124 (Invention) | 269 | 0.05 |
| 125 (Comparative) | 210 | 0.06 |

TABLE 5-continued

| Sample No. | Relative sensitivity | Raw sample storage stability (ΔD) |
|---|---|---|
| 126 (Comparative) | 211 | 0.06 |
| 127 (Invention) | 267 | 0.06 |
| 128 (Invention) | 252 | 0.05 |
| 129 (Invention) | 255 | 0.07 |
| 130 (Comparative) | 200 | 0.06 |
| 131 (Invention) | 259 | 0.05 |
| 132 (Comparative) | 203 | 0.07 |

(The smaller ΔD is, the more excellent the raw sample storage stability is.)

As is apparent from Table 5, it can be understood that storage stability of raw samples can be noticeably improved while keeping high sensitivity by the use of silver halide photographic emulsions containing silver halide grains mainly having a (100) face and the crown ethers according to the invention.

Example 2

On a support wherein polyethylene was laminated on one side and polyethylene containing titanium oxide was contained on the other side (on which photographic constituting layers would be coated), each layer having the following constitution was coated so that a multilayer silver halide color photographic light-sensitive material 201 was prepared. The coating solution was prepared as follows.

Coating solution for 1st layer

To 26.7 g of yellow coupler (Y-1), 10.0 g of dye image stabilizer (ST-1), 6.67 g of ST-2, 0.67 g of additive (HQ-1) and 6.67 g of high boiling organic solvent (DNP), 60 ml of ethyl acetate was added and dissolved. The solution was emulsified and dispersed in 220 ml of a 10% aqueous gelatin solution containing 7 ml of a 20% surfactant (SU-1) solution by the use of a supersonic homogenizer to prepare a yellow coupler dispersant. To the dispersant was added an anti-mildew agent (B-1) The resulting dispersant was mixed with the following blue sensitive silver halide emulsion (B-1) to prepare a coating solution for the first layer. The 2nd layer through the 7th layer were prepared in the same manner as in the above-mentioned coating solution for the 1st layer.

| Layer | Structure | Added amount (g/m$^2$) |
|---|---|---|
| 7th layer (Protective layer) | Gelatin | 1.00 |
| 6th layer (UV absorbing layer) | Gelatin | 0.4 |
| | UV absorber (UV-1) | 0.10 |
| | UV absorber (UV-2) | 0.04 |
| | UV absorber (UV-3) | 0.16 |
| | Anti-stain agent (HQ-1) | 0.01 |
| | DNP | 0.2 |
| | PVP | 0.03 |
| 5th later (Red sensitive | Gelatin | 1.00 |
| | Red sensitive silver | 0.24 in |

-continued

| Layer | Structure | Added amount (g/m$^2$) |
|---|---|---|
| layer) | bromochloride emulsion (The emulsion and the crown ether constitutes T-1 of Table 4, and sensitized in the same manner as in Example 1) | conversion to silver |
| | Cyan coupler (CC-1) | 0.29 |
| | Cyan coupler (CC-2) | 0.10 |
| | Dye image stabilizer (ST-1) | 0.20 |
| | Anti-stain agent (HQ-1) | 0.01 |
| | HBS-1 | 0.20 |
| | DOP | 0.20 |
| 4th layer (UV absorbing layer) | Gelatin | 0.94 |
| | UV absorber (UV-1) | 0.28 |
| | UV absorber (UV-2) | 0.09 |
| | UV absorber (UV-3) | 0.38 |
| | Anti-stain agent (HQ-1) | 0.03 |
| | DSP | 0.40 |
| 3rd layer (Green sensitive layer) | Gelatin | 1.40 |
| | Green sensitive emulsion | 0.36 in conversion to silver |
| | Magenta coupler (MM-1) | 0.35 |
| | Dye image stabilizer (ST-3) | 0.15 |
| | Dye image stabilizer (ST-4) | 0.15 |
| | Dye image stabilizer (ST-5) | 0.15 |
| | DNP | 0.20 |
| 2nd layer (Intermediate layer) | Gelatin | 1.20 |
| | Anti-stain agent (HQ-2) | 0.12 |
| | DIDP | 0.15 |
| 1st layer (Blue sensitive layer) | Gelatin | 1.20 |
| | Blue sensitive emulsion | 0.30 |
| | Yellow coupler (YY-1) | 0.80 |
| | Dye image stabilizer (ST-1) | 0.30 |
| | Dye image stabilizer (ST-2) | 0.20 |
| | Anti-stain agent (HQ-1) | 0.02 |
| | DNP | 0.20 |
| Support | Paper laminated with polyethylene | |

Incidentally, as hardeners, H-2 was added to 2nd layer and 4th layer and H-1 was added to 7th layer. Samples 202 to 212 were prepared in the same manner as in Sample 201, except that the emulsion used in the red sensitive layer were replaced as shown in Table 6.

(Preparation method of a blue sensitive emulsion)

To a silver bromochloride emulsion (the silver chloride content is 99.8 mol %, the average grain size is 0.70 μm and the variation coefficient is 7%), sodium thiosulfate and of the following sensitizing dye (BS) were added at 60° C. $4\times10^{-4}$ mol per mol of silver for the most suitable sensitization.

(Preparation method of a green sensitive emulsion)

To a silver bromochloride emulsion (the silver chloride content is 99.5 mol %, the average grain size is 0.40 μm and the variation coefficient is 8%), sodium thiosulfate, sodium chloroaurate and $3\times10^{-4}$ mol per mol of silver of the following sensitizing dye (GS) were added at 65° for the most suitable sensitization.

YY-1
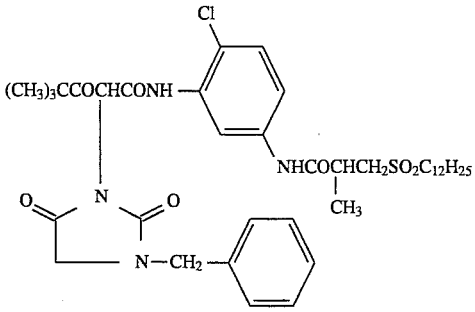
MM-1
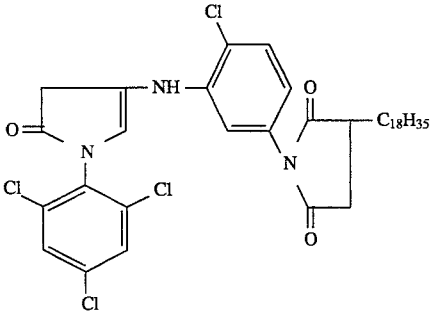
ST-2
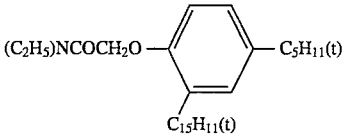
ST-3
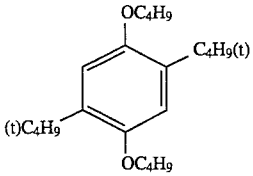
ST-4
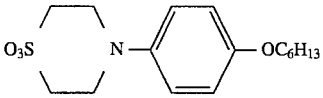
ST-5
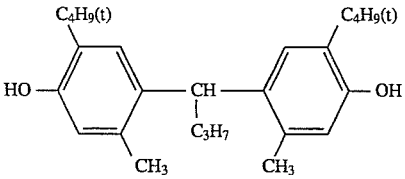
UV-1
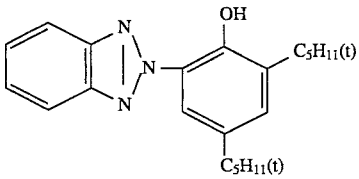
UV-2
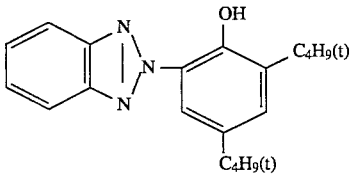
UV-3
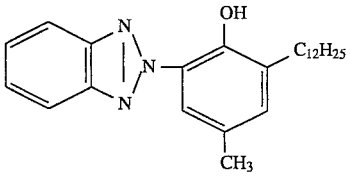
Diisodecylphthalate DIDP
Polyvinylpyrrolidone PVP
HBS-1
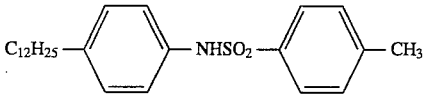
B-1
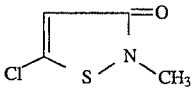
HQ-2
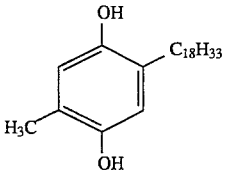
SU-1
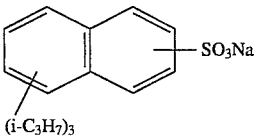

-continued

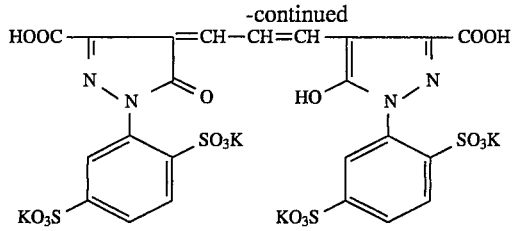

AI-2

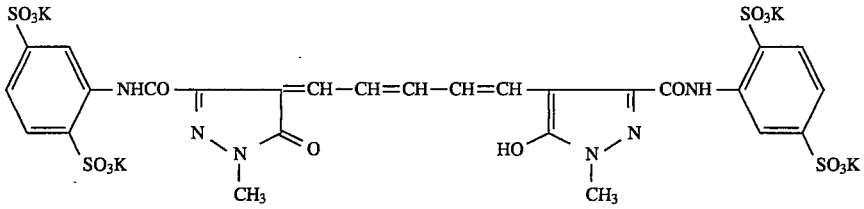

AI-3

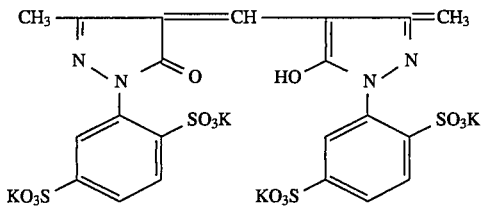

AI-1 $C(CH_2SO_2CH{=}CH_2)_4$ 0.07 g/m$^2$ H-2

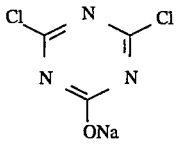

H-1 0.05 g/m$^2$

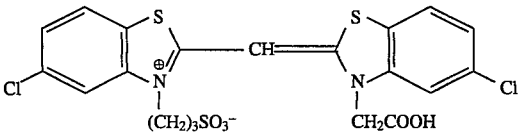

BS

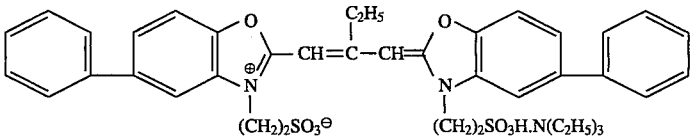

GS

The relative sensitivity and the storage stability of the thus obtained samples were evaluated in the same manner as in Example 1. Table 6 shows the results thereof.

TABLE 6

| Sample No. | Constitution of red sensitive emulsion | Relative sensitivity | Raw sample storage stability (ΔD) |
|---|---|---|---|
| 201 (Comparative) | T-1 | 100 | 0.16 |
| 202 (Comparative) | T-4 | 96 | 0.15 |
| 203 (Comparative) | T-11 | 225 | 0.31 |
| 204 (Comparative) | T-12 | 192 | 0.32 |
| 205 (Comparative) | T-14 | 240 | 0.22 |
| 206 (Comparative) | T-15 | 201 | 0.24 |
| 207 (Invention) | T-18 | 261 | 0.04 |
| 208 (Comparative) | T-20 | 207 | 0.04 |
| 209 (Invention) | T-24 | 267 | 0.04 |
| 210 (Comparative) | T-26 | 206 | 0.06 |
| 211 (Invention) | T-31 | 265 | 0.05 |
| 212 (Comparative) | T-32 | 208 | 0.06 |

From Table 6, it can be understood that, in multilayer color papers too, the silver halide emulsion of the present invention containing silver halide grains composed mainly of a (100) face and containing one kind or more crown ethers forming a 18-membered ring condensed with at least one substituted or unsubstituted aromatic ring gives a light-sensitive material having stably high sensitivity and improved storage stability.

What is claimed is:

1. A silver halide photographic light-sensitive material comprising a support and, provided thereon, a silver halide emulsion layer, containing silver bromochloride grains having a silver bromide content of 0.01 to 2 mol % and having a (100) face, and a crown ether having a 18-membered ring condensed with at least one aromatic ring, wherein said silver halide grains satisfy the following inequality:

$$15 \leqq K$$

wherein K is defined to be (intensity of a diffraction line attributed to a (200) face)/(intensity of a diffraction line attributed to a (222) face), said intensity being measured by an X-ray diffraction method.

2. The material of claim 1, wherein said silver halide emulsion further contains in an amount of $2\times10^{-8}$ to $1\times10^{-2}$ mol per mol of silver a red-sensitive sensitizing dye represented by the following Formula (I) or (II):

Formula (I)

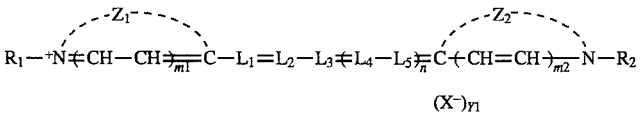

Formula (II)

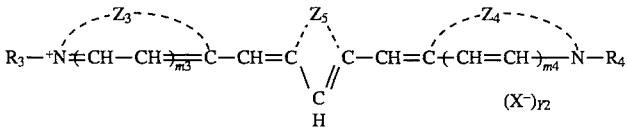

wherein $R_1$, $R_2$, $R_3$, and $R_4$ independently represent an alkyl group, an alkenyl group or an aryl group; $L_1$, $L_2$, $L_3$, $L_4$ and $L_5$ independently represent a methine group; $Z_1$, $Z_2$, $Z_3$, and $Z_4$ independently represent an atom or atomic group necessary to form a 5- or 6-membered heterocyclic ring; $Z_5$ represents a hydrocabon atomic group necessary to form a 6-membered ring; $m_1$, $m_2$, $m_3$, and $m_4$ independently represent 0 or 1; n represents 0 or 1; $X^-$ represents an anion; and $Y_1$ and $Y_2$ independently represent 0 or 1.

3. The material of claim 2 wherein said red-sensitive sensitizing dye is one represented by the following Formula (III) or (IV):

Formula (III)

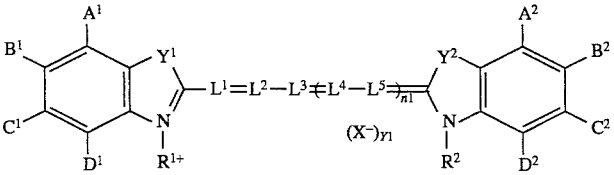

Formula (IV)

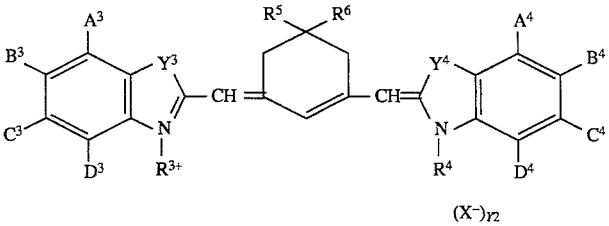

wherein $Y^1$, $Y^2$, $Y^3$, and $Y^4$ independently represent an oxygen atom, a sulfur atom or a selenium atom; $A^1$, $A^2$, $A^3$, $A^4$, $B^1$, $B^2$, $B^3$, $B^4$, $C^1$, $C^2$, $C^3$, $C^4$, $D^1$, $D^2$, $D^3$, and $D^4$ independently represent a hydrogen atom, a halogen atom, an alkyl group, an alkoxy group, a phenyl group, a cyano group, a nitro group or an alkoxycarbonyl group, provided that at least one of $A^1$ and $B^1$, $B^1$ and $C^1$, $C^1$ and $D^1$, $A^2$ and $B^2$, $B^2$ and $C^2$, $C^2$ and $D^2$, $A^3$ and $B^3$, $B^3$ and $C^3$, $C^3$ and $D^3$, $A^4$ and $B^4$, $B^4$ and $C^4$, and $C^4$ and $D^4$ may combine to form a benzene ring; $R^5$ and $R^6$ independently represent methyl, ethyl, propyl, butyl, or trifluoromethyl groups; $R^1$, $R^2$, $R^3$, and $R^4$ independently represent an alkyl group, an alkenyl group or an aryl group; $L^1$, $L^2$, $L^3$, $L^4$ and $L^5$ independently represent a methine group; $n^1$ represents 0 or 1; $X^-$ represents an anion; and $Y^1$ and $Y^2$ independently represent 0 or 1.

4. The material of claim 1, wherein said silver halide emulsion layer contains the crown ether in an amount of $1\times10^{-6}$ to $1\times10^{-1}$ mol per mol of silver.

5. The material of claim 1, wherein said silver halide grains are cubic or tetradecahedral.

6. A silver halide photographic light-sensitive material comprising a support and provided thereon, a blue sensitive silver halide emulsion layer, a green sensitive silver halide emulsion layer and a red sensitive silver halide emulsion layer, each layer containing silver bromochloride grains having a (100) face and satisfying the following inequality:

$$15 \leqq K$$

wherein K is defined to be (intensity of a diffraction line attributed to a (200) face)/(intensity of a diffraction line attributed to a (222) face), said intensity being measured by an X-ray diffraction method, and said red sensitive layer containing a crown ether having a 18-membered ring condensed with at least one aromatic ring in an amount of $1\times10^{-6}$ to $1\times10^{-1}$ mol per mol of silver and a red-sensitive sensitizing dye in an amount of $2\times10^{-8}$ to $1\times10^{-2}$ mol per mol of silver, said red sensitive dye being represented by the following Formula (I) or (II):

Formula (I)

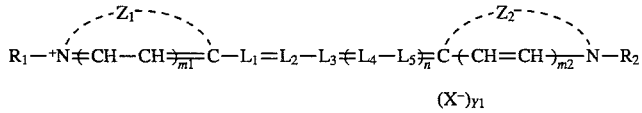

-continued

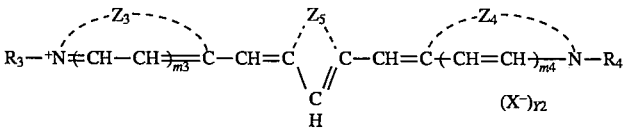

Formula (II)

wherein $R_1$, $R_2$, $R_3$, and $R_4$ independently represent an alkyl group, an alkenyl group or an aryl group; $L_1$, $L_2$, $L_3$, $L_4$ and $L_5$ independently represent a methine group; $Z_1$, $Z_2$, $Z_3$, and $Z_4$ independently represent an atom or atomic group necessary to form a 5- or 6-membered heterocyclic ring; $Z_5$ represents a hydrocabon atomic group necessary to form a 6-membered ring; $m_1$, $m_2$, $m_3$, and $m_4$ independently represent 0 or 1; n represents 0 or 1; $X^-$ represents an anion; and $Y_1$ and $Y_2$ independently represent 0 or 1.

7. The material of claim 6, wherein said silver bromochloride grains have a silver bromide content of 0.01 to 2 mol %.

* * * * *